US008662563B1

(12) United States Patent
Hardenbrook

(10) Patent No.: US 8,662,563 B1
(45) Date of Patent: Mar. 4, 2014

(54) RETRACTABLE VEHICLE CANOPY ASSEMBLY

(76) Inventor: Ann M. Hardenbrook, Largo, FL (US)

( * ) Notice: Subject to any disclaimer, the term of this patent is extended or adjusted under 35 U.S.C. 154(b) by 36 days.

(21) Appl. No.: 13/434,286

(22) Filed: Mar. 29, 2012

(51) Int. Cl.
*E04H 15/06* (2006.01)

(52) U.S. Cl.
USPC ..... 296/154; 135/88.07

(58) Field of Classification Search
USPC ..... 296/154, 136.06, 136.1, 136.12, 296/136.13, 95.1; 135/88.05, 88.07, 88.09
See application file for complete search history.

(56) References Cited

U.S. PATENT DOCUMENTS

| | | | | |
|---|---|---|---|---|
| 1,425,954 | A * | 8/1922 | Fischer | 296/99.1 |
| 1,845,577 | A * | 2/1932 | Berliawsky | 296/152 |
| 3,957,301 | A * | 5/1976 | Huber | 296/95.1 |
| 4,171,013 | A | 10/1979 | Clark | |
| 4,848,827 | A * | 7/1989 | Ou | 296/99.1 |
| 4,950,020 | A * | 8/1990 | Chen | 296/95.1 |
| 5,004,290 | A * | 4/1991 | Kim | 296/99.1 |
| 5,230,545 | A | 7/1993 | Huang et al. | |
| 6,006,811 | A * | 12/1999 | Brutsaert | 160/71 |
| 6,044,856 | A | 4/2000 | Cano | |
| 6,079,163 | A * | 6/2000 | Daoud | 52/74 |
| 6,341,811 | B1 | 1/2002 | Schoelkopf | |
| 6,619,726 | B2 | 9/2003 | Jones | |
| 6,782,904 | B2 * | 8/2004 | Tien | 135/88.07 |
| 6,782,936 | B1 * | 8/2004 | Girard et al. | 160/66 |
| 6,997,497 | B2 * | 2/2006 | Sagi et al. | 296/37.7 |
| 7,086,684 | B2 * | 8/2006 | Glaser et al. | 296/99.1 |
| 7,819,458 | B2 | 10/2010 | Raynor | |
| 8,366,172 | B1 * | 2/2013 | Morazan | 296/97.1 |

* cited by examiner

*Primary Examiner* — H Gutman

(57) ABSTRACT

A retractable vehicle canopy assembly provides temporary shelter from precipitation or sun. The assembly includes a housing having a bottom, a top, and a perimeter wall extending between the bottom and the top defining an interior space. The bottom of the housing is configured for coupling to a vehicle adjacent to a door of the vehicle. A slot extends through the perimeter wall of the housing. A plurality of rails is positioned in the interior space. Each of the rails is selectively extendable from the interior space through the slot. A cover is coupled to the rails and extending outwardly from the slot when the rails are extended from the slot whereby the cover is configured to shelter an area adjacent to the door of the vehicle.

17 Claims, 4 Drawing Sheets

RETRACTABLE VEHICLE CANOPY ASSEMBLY

BACKGROUND OF THE DISCLOSURE

Field of the Disclosure

The disclosure relates to canopy devices and more particularly pertains to a new canopy device for selectively providing temporary shelter from precipitation adjacent to a vehicle door.

SUMMARY OF THE DISCLOSURE

An embodiment of the disclosure meets the needs presented above by generally comprising a housing having a bottom, a top, and a perimeter wall extending between the bottom and the top defining an interior space. The bottom of the housing is configured for coupling to a vehicle adjacent to a door of the vehicle. A slot extends through the perimeter wall of the housing. A plurality of rails is positioned in the interior space. Each of the rails is selectively extendable from the interior space through the slot. A cover is coupled to the rails and extending outwardly from the slot when the rails are extended from the slot whereby the cover is configured to shelter an area adjacent to the door of the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
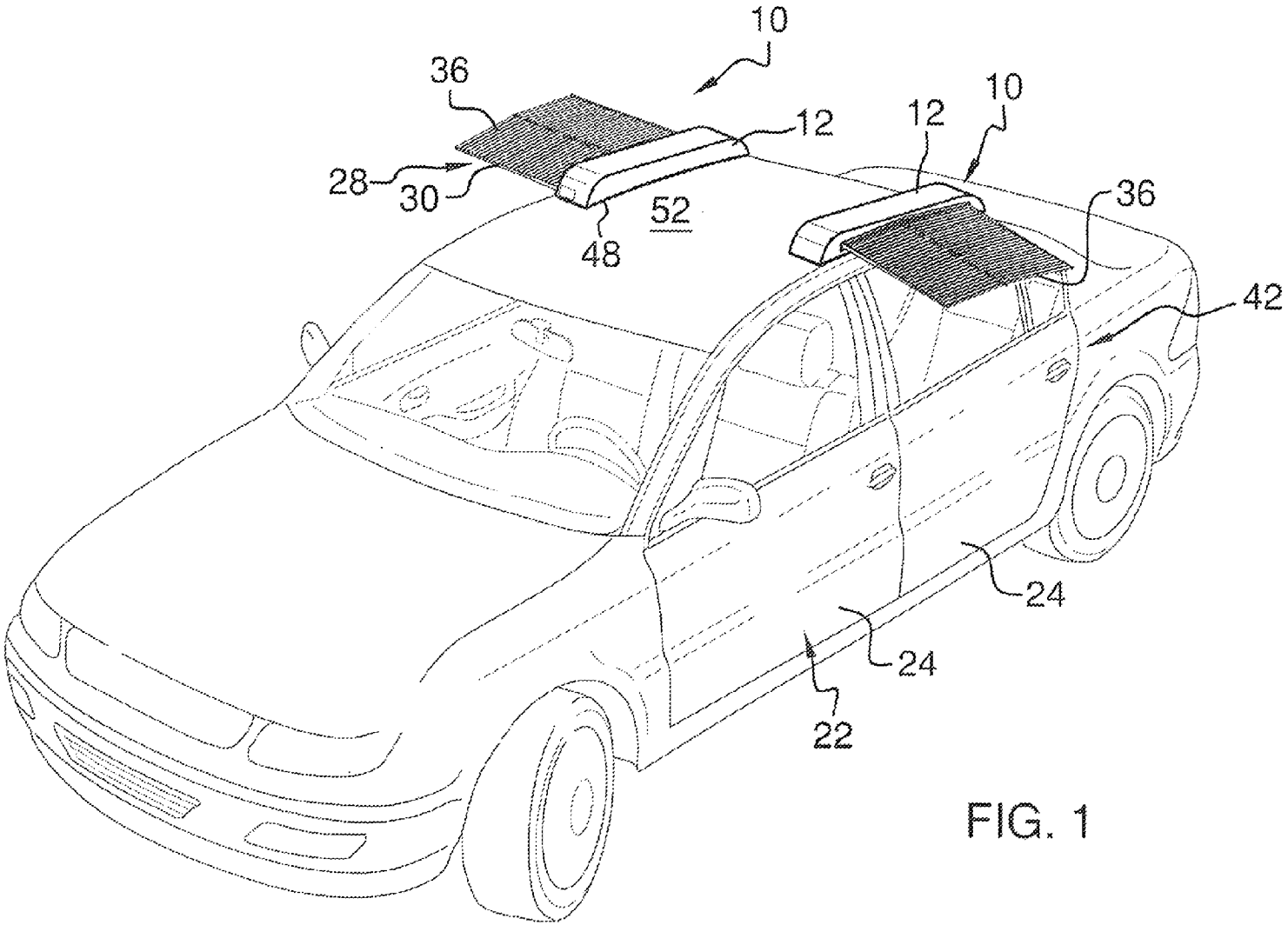
FIG. 1 is a top front side perspective view of a retractable vehicle canopy assembly according to an embodiment of the disclosure.
Figure 2:
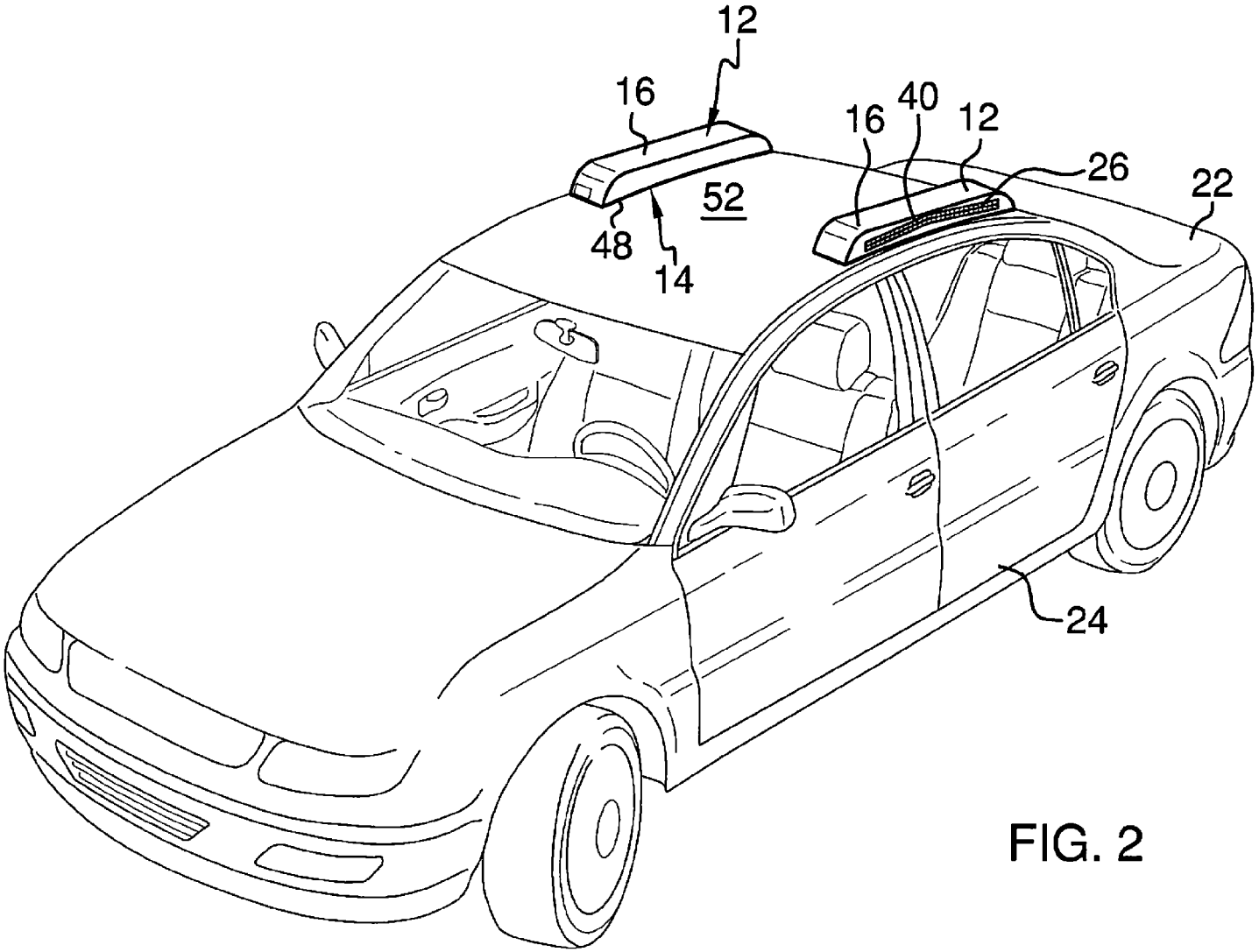
FIG. 2 is a top front side perspective view of an embodiment of the disclosure in a retracted position.
Figure 3:
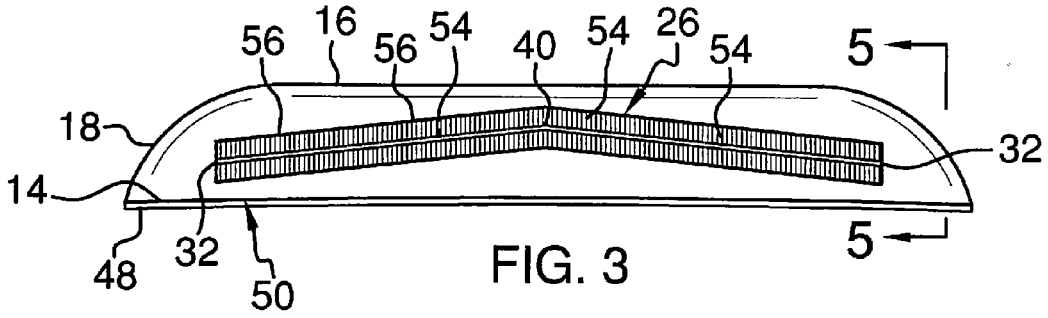
FIG. 3 is a front view of an embodiment of the disclosure.
Figure 4:
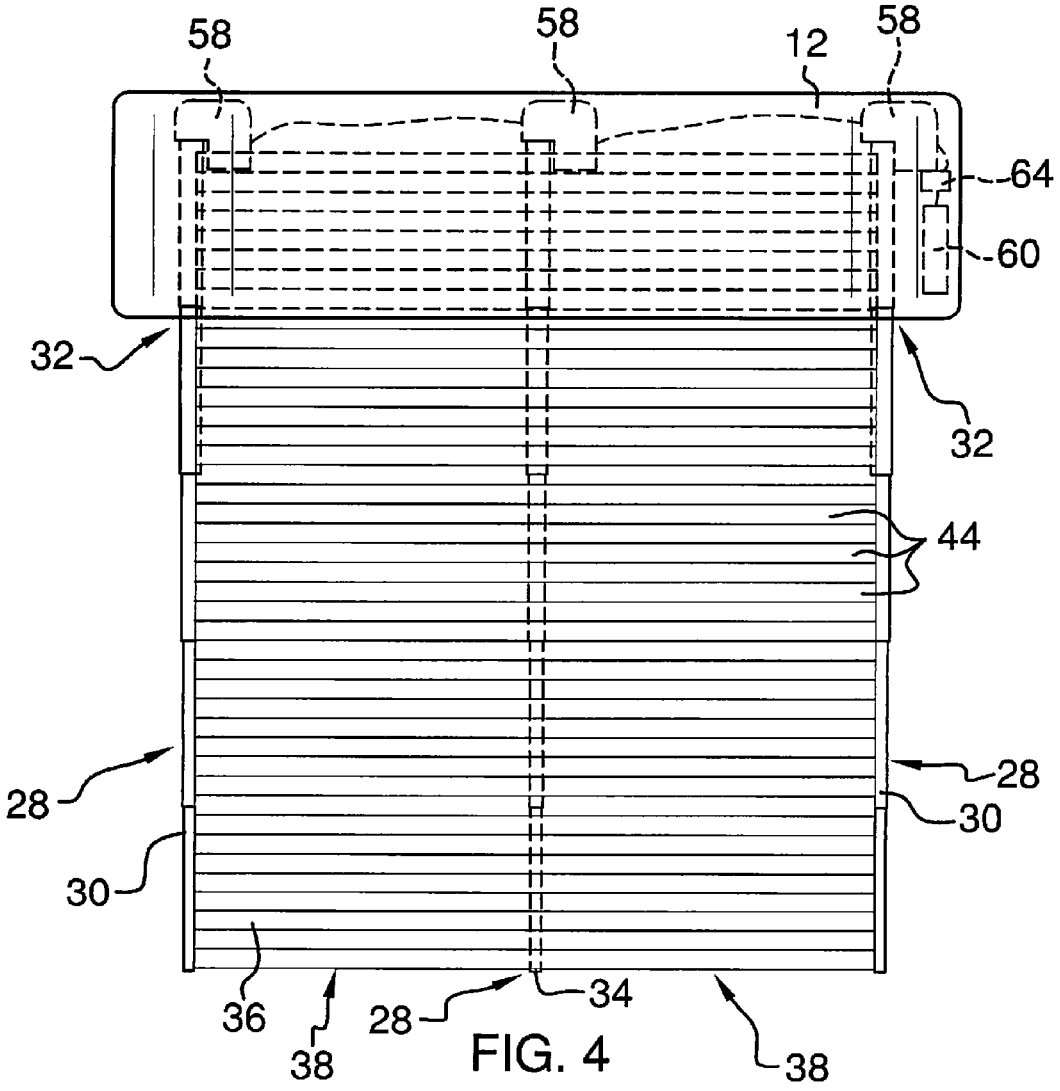
FIG. 4 is a top view of an embodiment of the disclosure.
Figure 5:
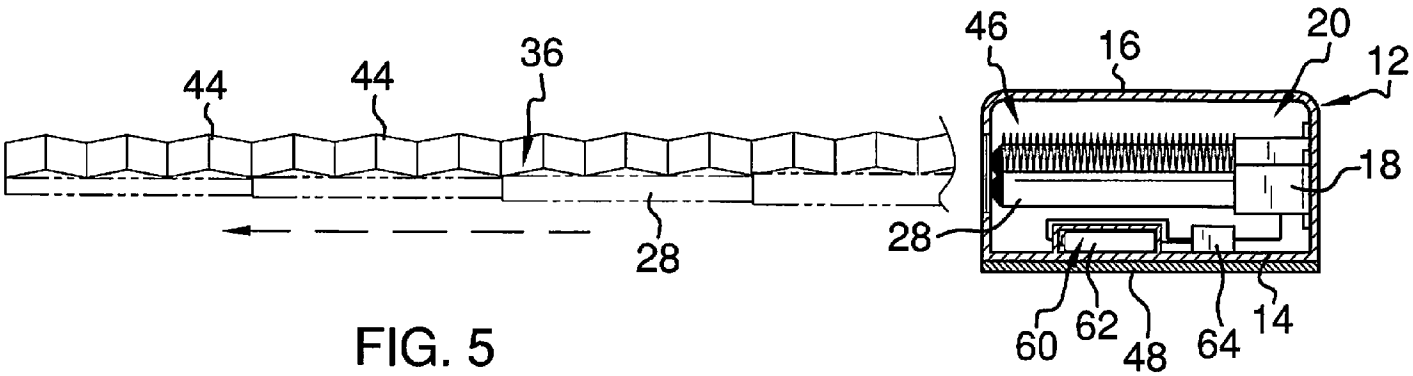
FIG. 5 is a cross-sectional view of an embodiment of the disclosure taken along line 5-5 of FIG. 3.
Figure 6:
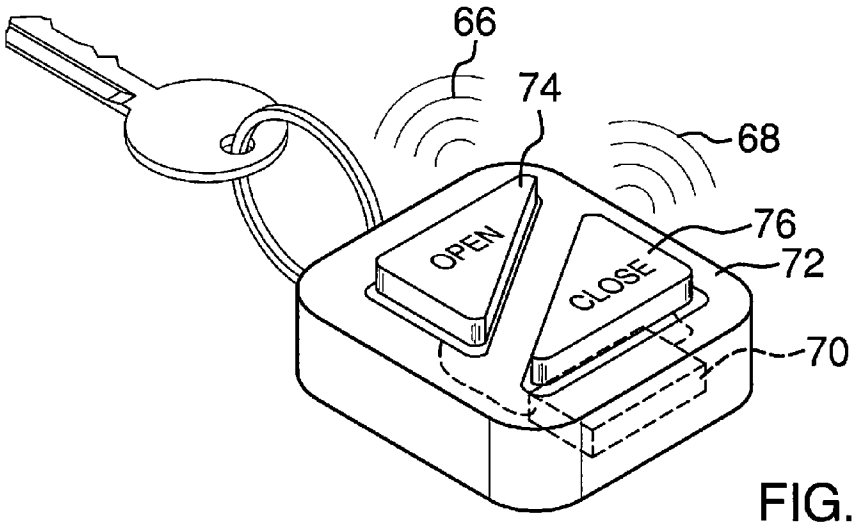
FIG. 6 is a top front side perspective view of an actuator of an embodiment of the disclosure.

With reference now to the drawings, and in particular to FIGS. 1 through 6 thereof, a new canopy device embodying the principles and concepts of an embodiment of the disclosure and generally designated by the reference numeral 10 will be described.

As best illustrated in FIGS. 1 through 6, the retractable vehicle canopy assembly 10 generally comprises a housing

12 having a bottom 14, a top 16, and a perimeter wall 18 extending between the bottom 14 and the top 16 defining an interior space 20. The bottom 14 of the housing 12 is configured for coupling to a vehicle 22 adjacent to a door 24 of the vehicle 22. A slot 26 extends through the perimeter wall 18 of the housing 12. A plurality of segmented rails 28 are provided. Each of the rails 28 is positioned in the interior space 20 and selectively extendable from the interior space 20 through the slot 26. The rails 28 are parallel to each other. The plurality of rails 28 includes a pair of outer rails 30. Each outer rail 30 is positioned proximate an associated end 32 of the slot 26. The plurality of rails 28 also includes a medial rail 34 positioned between the outer rails 30.

A cover 36 is coupled to the rails 28. The cover 36 has a pair of outer sections 38. Each outer section 38 of the cover 36 extends between the medial rail 34 and an associated one of the outer rails 30. The medial rail 34 is horizontally spaced above the outer rails 30. The outer sections 38 of the cover 36 slope downwardly away from the medial rail 34. The slot 26 is peaked at a medial point 40 aligned with the medial rail 34. The cover 36 extends outwardly from the slot 26 when the rails 28 are extended from the slot 26 whereby the cover 36 is configured to shelter an area 42 adjacent to the door 24 of the vehicle 22. The cover 36 is pleated forming a plurality of pleats 44 extending transversely across the rails 28 whereby the cover 36 folds into a compact storage position 46 when the rails 28 are retracted and positioned fully in the housing 12.

A magnetic coupler 48 may be coupled to a bottom surface 50 of the bottom 14 of the housing 12. The coupler 48 may be coextensive with the bottom surface 50 and is configured for removably coupling to an outer surface 52 of the vehicle 22.

A plurality of bristles 54 is coupled to the housing 12 lining a perimeter edge 56 of the slot 26. The bristles 54 inhibit debris from entering the interior space 20 through the slot 26.

A plurality of rail motors 58 is positioned in the housing 12. Each rail motor 58 is operationally coupled to an associated one of the rails 28 to selectively extend and retract the associated rail 28. A power source 60 is positioned in the housing 12 and operationally coupled to each of the rail motors 58 to provide needed power to operate the rail motors 58. The power source 60 may be a battery 62 positioned in a battery compartment 64 in the housing 12.

A receiver 64 may also be positioned in the housing 12. The receiver 64 is operationally coupled to each of the rails 28 and rail motors 58 whereby the rails 28 are extended upon reception of an extension signal 66 by the receiver 64. The rails 28 are also retracted upon reception of a retraction signal 68 by the receiver 64. As an alternative, a single signal may be used which simply activates the rail motors 58 to move from one position to another. A remote transmitter 70 may be provided in a remote control 72 such as a key fob or the like. The transmitter 70 selectively sends the extension signal 66 and the retraction signal 68. The transmitter 70 is positioned in the remote control 72. An open button 74 is coupled to the remote control 72 and operationally coupled to the transmitter 70 whereby the extension signal 66 is transmitted by the transmitter 70 upon pressing of the open button 74. Likewise, a close button 76 is coupled to the remote control 72 and operationally coupled to the transmitter 70 whereby the retraction signal 68 is transmitted by the transmitter 70 upon pressing of the close button 76.

In use, the housing 12 may be stored until the weather is such that a person desires shelter in the area 42 adjacent to the door 24 of the vehicle 22. The coupler 48 engages the vehicle 22 holding the housing 12 in a desired position with the slot 26 facing the area 42 adjacent to the door 24 of the vehicle 22. The cover 36 is extended to provide shelter to the area 42 as desired when entering or exiting the vehicle 22. The cover is retracted after the door 24 of the vehicle 22 is closed. Multiple such housings 12 and covers 36 may be used on a single vehicle 22 controlled by a single transmitter 70 or each having their own associated transmitter 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot, said plurality of rails including a pair of outer rails, each outer rail being positioned proximate an associated end of said slot; and a cover coupled to said rails, said cover extending outwardly from said slot when said rails are extended from said slot whereby said cover is configured to shelter an area adjacent to the door of the vehicle.

2. The assembly of claim 1, further including a coupler coupled to a bottom surface of said bottom of said housing, said coupler being configured for removably coupling to an outer surface of the vehicle.

3. The assembly of claim 2, further including said coupler being magnetic.

4. The assembly of claim 1, further comprising:

said plurality of rails including a medial rail positioned between said outer rails; and said cover having a pair of outer sections, each outer section of said cover extending between said medial rail and an associated one of said outer rails.

5. The assembly of claim 4, further including said medial rail being horizontally spaced above said outer rails whereby said outer sections of said cover slope downwardly away from said medial rail.

6. The assembly of claim 5, further including said slot being peaked at a medial point aligned with said medial rail.

7. The assembly of claim 1, further comprising:

said plurality of rails including a medial rail positioned between said outer rails;

said cover having a pair of outer sections, each outer section of said cover extending between said medial rail and an associated one of said outer rails, said medial rail being horizontally spaced above said outer rails whereby said outer sections of said cover slope downwardly away from said medial rail, said slot being peaked at a medial point aligned with said medial rail, said cover being pleated whereby said cover folds into a compact storage position when said rails are positioned fully in said housing;

a magnetic coupler coupled to a bottom surface of said bottom of said housing, said coupler being configured for removably coupling to an outer surface of the vehicle;

a plurality of bristles coupled to said housing lining a perimeter edge of said slot;

a plurality of rail motors positioned in said housing, each rail motor being operationally coupled to an associated one of said rails to selectively extend and retract said associated rail;

a power source positioned in said housing, said power source being operationally coupled to each of said rail motors, said power source being a battery;

a receiver positioned in said housing, said receiver being operationally coupled to each of said rails whereby said rails are extended upon reception of an extension signal by said receiver, said rails being retracted upon reception of a retraction signal by said receiver;

a remote transmitter, said transmitter selectively sending said extension signal and said retraction signal;

a remote control, said transmitter being positioned in said remote control;

an open button coupled to said remote control, said open button being operationally coupled to said transmitter whereby said extension signal is transmitted by said transmitter upon pressing of said open button; and a close button coupled to said remote control, said close button being operationally coupled to said transmitter whereby said retraction signal is transmitted by said transmitter upon pressing of said close button.

8. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot;

a cover coupled to said rails, said cover extending outwardly from said slot when said rails are extended from said slot whereby said cover is configured to shelter an area adjacent to the door of the vehicle; and a plurality of bristles coupled to said housing lining a perimeter edge of said slot.

9. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot;

a cover coupled to said rails, said cover extending outwardly from said slot when said rails are extended from said slot whereby said cover is configured to shelter an area adjacent to the door of the vehicle; and a plurality of rail motors positioned in said housing, each rail motor being operationally coupled to an associated one of said rails to selectively extend and retract said associated rail.

10. The assembly of claim 9, further including a power source positioned in said housing, said power source being operationally coupled to each of said rail motors.

11. The assembly of claim 10, further including said power source being a battery.

12. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot;

a cover coupled to said rails, said cover extending outwardly from said slot when said rails are extended from said slot whereby said cover is configured to shelter an area adjacent to the door of the vehicle; and each rail being segmented.

13. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot;

a cover coupled to said rails, said cover extending outwardly from said slot when said rails are extended from said slot whereby said cover is configured to shelter an area adjacent to the door of the vehicle; and a receiver positioned in said housing, said receiver being operationally coupled to each of said rails whereby said rails are extended upon reception of an extension signal by said receiver.

14. The assembly of claim 13, further including said rails being retracted upon reception of a retraction signal by said receiver.

15. The assembly of claim 14, further including a remote transmitter, said transmitter selectively sending said extension signal and said retraction signal.

16. The assembly of claim 15, further comprising:

a remote control, said transmitter being positioned in said remote control;

an open button coupled to said remote control, said open button being operationally coupled to said transmitter whereby said extension signal is transmitted by said transmitter upon pressing of said open button; and a close button coupled to said remote control, said close button being operationally coupled to said transmitter whereby said retraction signal is transmitted by said transmitter upon pressing of said close button.

17. A vehicle canopy assembly comprising:

a housing having a bottom, a top, and a perimeter wall extending between said bottom and said top defining an interior space, said bottom of said housing being configured for coupling to a vehicle adjacent to a door of the vehicle;

a slot extending through said perimeter wall of said housing;

a plurality of rails, each of said rails being positioned in said interior space, each of said rails being selectively extendable from said interior space through said slot;

a cover coupled to said rails, said cover extending outwardly from said slot when said rails are extended from said slot whereby said cover is configured to shelter an area adjacent to the door of the vehicle; and said cover being pleated whereby said cover folds into a compact storage position when said rails are positioned fully in said housing.

* * * * *